United States Patent [19]

Bradley

[11] 4,002,164

[45] Jan. 11, 1977

[54] PROSTATE MASSAGER

[76] Inventor: Willie Ray Bradley, 175 S. Rio Vista St., No. 146, Anaheim, Calif. 92806

[22] Filed: Sept. 2, 1975

[21] Appl. No.: 609,207

[52] U.S. Cl. ..... 128/67

[51] Int. Cl.[2] ..... A61H 7/00

[58] Field of Search ..... 128/62, 67, 60, 79, 128/24.1, 341, 345, 343

[56] References Cited

UNITED STATES PATENTS

| | | | |
|---|---|---|---|
| 2,065,779 | 12/1936 | William | 128/343 X |
| 2,342,557 | 2/1942 | Ross et al. | 128/60 |
| 2,721,549 | 10/1955 | Ferraro | 128/341 X |
| 3,496,930 | 2/1970 | Wappler | 128/345 X |

*Primary Examiner*—Lawrence W. Trapp

[57] ABSTRACT

A prostate massager for use as a medical instrument for massaging and treating an inflammatory prostate gland, the massager comprising a flexible, digital-massaging head adapted to be inserted into the rectum and positioned adjacent the prostate gland, the digital head being removably attached to a substantially U-shaped handle having a coupling neck member disposed between the digital head and handle, wherein the depth of insertion is controlled by a shoulder ring which is adjustably mounted to the neck member. The massaging head is flexibly operated by a control line that is connected at one end to the head, the opposite end thereof being free for manipulating the massaging head.

5 Claims, 4 Drawing Figures

10
12
14
16
18
20
22
24
25
26
28
30
32
34
36
38
40
42
44
45
46
47
48
50
52
54
56
58
60
62

PROSTATE MASSAGER

BACKGROUND OF THE INVENTION

1. Field of the Invention

This invention relates generally to a massaging device and, more particularly, to a prostate-massaging device for the treatment of inflammatory prostate glands—heretofore only performed by medical doctors.

2. Description of the Prior Art

Many diseases of the prostate, most of which are inflammatory, are occasionally treated by intermittent prostatic massage. This is a simple procedure usually performed by a physician in his office. There is a certain amount of discomfort associatd with the treatment thereof; and, because of this and the time required to visit a physician in his office, it would therefore be beneficial to provide a means whereby the patient could perform his own prostatic massage.

To the applicant's knowledge no massage device has yet been devised whereby the patient can perform his own massage treatment under the supervision of his doctor.

SUMMARY OF THE INVENTION

The present invention relates to a prostate massager which is designed to be used by a patient, under the direction and control of his physician, for the treatment of various prostatic diseases, most of which are inflammatory. The treatment thereof generally consists of periodic, digital massages performed directly on the prostate gland. Thus, entrance must be made through the anus in the male human due to the fact that the prostate gland is positioned substantially at the neck of the urinary bladder and surrounds the urethra—the tube which carries the urine from the bladder—like the insulation around a pipe, and is composed of muscular and glandular tissue which is located adjacent the rectum approximately 2 inches or so from the entrance thereof.

Accordingly, the present massage device comprises a digital massaging head removably secured to a handle, the digital head being constructed of a flexible, surgical rubber or plastic having a spring-biasing member disposed therein, which is operated by a control line, whereby the digital head can be manipulated to cause a massaging action similar to that by a physician's finger, which is now the method being used. That is, the head is inserted into the rectum in much the same way that the tip of an enema tube is inserted and positioned adjacent the prostate area. The patient, at this time, pulls the control line, causing the digital head to geniculate gently and engage the prostate gland. In addition, the handle is designed in a substantially U-shaped configuration, whereby the rotating of the handle will also provide an additional massaging movement thereto.

An adjustable means is also included within the device, whereby the depth to which the head is inserted in the rectum may be selected to allow for individual differences in patients' anatomy.

OBJECTS AND ADVANTAGES OF THE INVENTION

The present invention has for an important object a provision whereby a patient having a prostatites condition (inflammation of the prostate gland) can, under his physician's supervision, treat the above condition by giving himself a prostatic massage.

It is another object of the invention to provide a prostate massager that is most easily inserted into the rectum from a sitting position with the legs separated.

It is still another object of the invention to provide a prostate massager that will achieve the same results as those achieved by digital massages by one's physician.

It is a further object of the invention to provide a prostate-massaging device of this character having relatively few operating parts which can be easily taken apart for cleaning.

It is still a further object of the invention to provide a device of this character that is easy to service and maintain.

Still another object of the invention is to provide a device of this character that is relatively inexpensive to manufacture.

The characteristics and advantages of the invention are further sufficiently referred to in connection with the accompanying drawings, which represent one embodiment. After considering this example, skilled persons will understand that variations may be made without departing from the principles disclosed and I contemplate the employment of any structures, arrangements or modes of operation that are properly within the scope of the appended claims.

DESCRIPTION OF THE DRAWINGS

Referring more particularly to the accompanying drawings, which are for illustrative purposes only.

DESCRIPTION OF THE PREFERRED EMBODIMENT

Figures 1, 2, 3, 4:
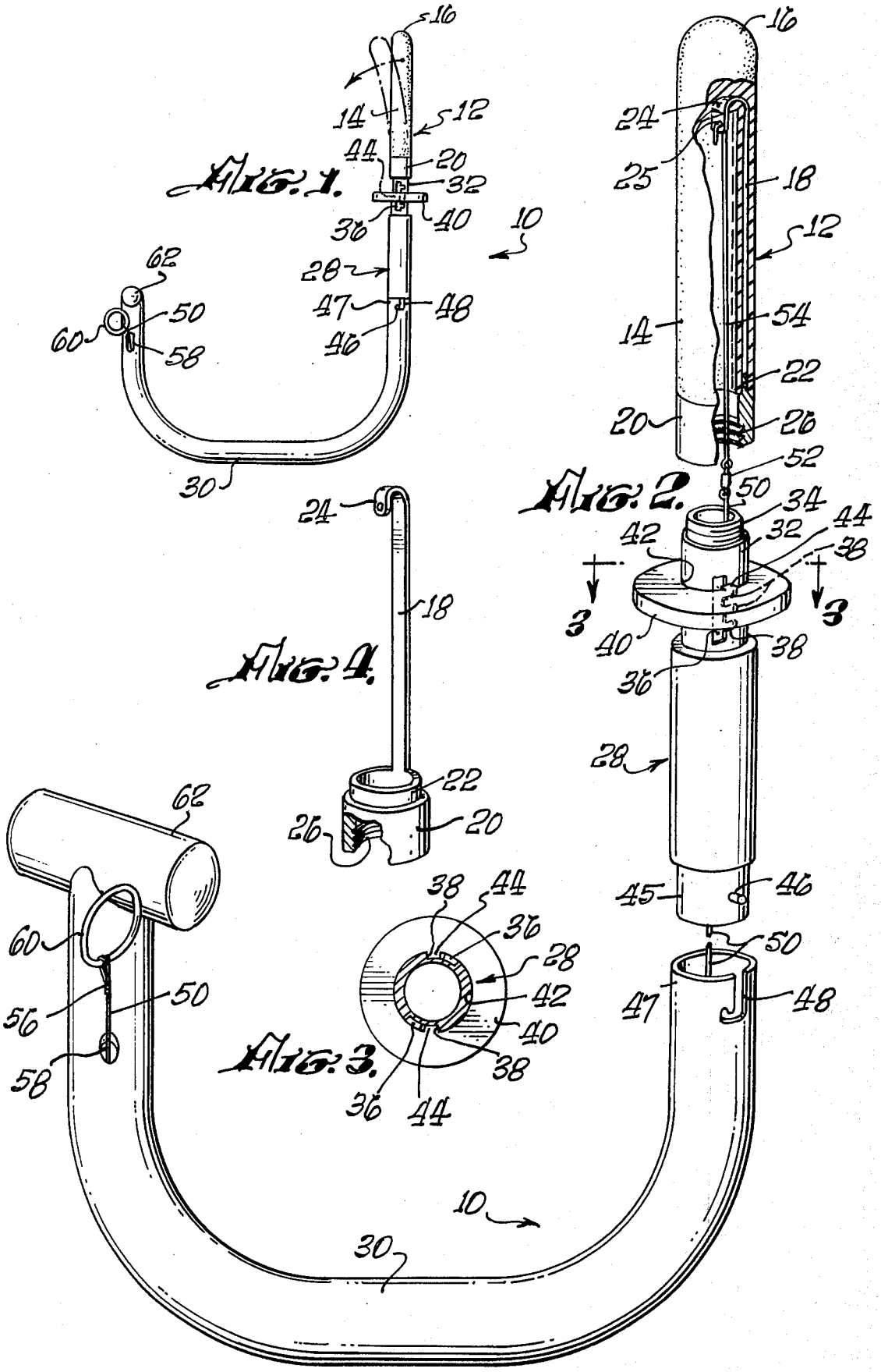
FIG. 1 is a side-elevational view of the present invention.
FIG. 2 is an enlarged, perspective view thereof showing the digital-massaging head and the neck member separated from the handle portion.
FIG. 3 is a cross-sectional view taken substantially along line 3—3 of FIG. 2, illustrating the depth adjusting means.
FIG. 4 is a perspective view of the spring means which is disposed within the digital head.

Referring more particularly to FIGS. 1 and 2 of the drawing, there is shown a prostate-massaging device, indicated generally at 10, comprising a flexible, digital-massaging head, generally indicated at 12. Said digital-massaging head includes a flexible, finger-like body 14 consisting of a surgical rubber or plastic material—which is well known in the medical art—that takes the shape of a longitudinal, cylindrical finger having the free end 16 rounded off for ease of access into the rectal area of a patient. A central bore is disposed therein approximately two-thirds the length of the head 12. Molded within the digital head 12 is a flexible, flat, elongated spring member 18, as seen in FIG. 1. In FIG. 4, the spring member is more clearly shown as being integrally formed with an internally-threaded base member 20. Said base member includes a reduced-diameter, annular wall 22 which aids in the support of body 14. That is, spring 18 and wall 22 are molded within the soft, pliable material of the head 12 (See FIG. 2). However, the upper, free end 24 of flat spring member 18 is bent back on itself and projects outwardly and downwardly from the solid, upper end 16—forming a means for attaching a manipulating control means thereto—said free end 24 having a hole 25 disposed therein. Said control means will hereinafter be described in detail.

Since the base 20 is provided with internal threads 26, it is readily removably attached to an intermediate neck member, generally designated at 28, which in turn is removably coupled by a coupling means to a substantially U-shaped hand 30. Said neck member has a reduced-diameter, boss member 32, said boss member being externally threaded at 34 for reception into base 20. Also included in boss 32 is an adjustable, insert-depth means which comprises a pair of oppositely-disposed, vertical slots 36 having a plurality of laterally-extending, smaller slots 38. Slidably fitted within these slots is an annular shoulder plate 40 having a central opening 42, through which boss 32 is received, a pair of oppositely-formed tabs 44 being slidable within the slots. Thus, by a simple rotation of the slate 40, the location of said ring can be changed and locked into different lateral slots 38.

A second reduced-diameter boss member 45 is formed at the lower end wherein a releasable coupling means is arranged between the neck 28 and handle 30. The releasable coupling means comprises a bayonet connection, wherein member 45 is provided with a pin 46; and the handle end 47 for securing neck 28 thereto includes an L-shaped slot 48, the operation thereof being well known.

Accordingly, prior to assembling the device 10, a manipulating control means comprising a control line 50, preferably of nylon cord, is interdisposed within the tubular hand 30 and neck 28, as seen in FIG. 2. The end which extends upwardly through neck 28 is connected by means of a swivel connection 52 to a linkage 54, said linkage being also connected to the free end 24 of spring 18. The opposite end 56 of the line 50 extends through aperture 58, at which point a pull ring 60 is attached thereto.

It should be mentioned that the handle is provided with a grip bar 62, whereby the patient grips the handle in one hand and operates the line 50 with the other hand.

When the device is assembled for use, one should adequately lubricate the digital head 12 with a water-soluble lubricant, and then gently insert the massager into the anus for the desired distance. The tip 16 of the digital head is now resting adjacent the prostate gland. By pulling ring 60, the flat spring 18 will bend, causing the digital massager to also bend, as seen in dotted lines in FIG. 1. In addition, the handle can be rotated in a back-and-forth movement, thus adding to the massaging action.

The invention and its attendant advantages will be understood from the foregoing description and it will be apparent that various changes may be made in the form, construction and arrangement of the parts of the invention without departing from the spirit and scope thereof or sacrificing its material advantages, the arrangement herein before described being merely by way of example, and I do not wish to be restricted to the specific form shown or uses mentioned, except as defined in the accompanying claims.

I claim:

1. A prostate-massaging device comprising:

a flexible, digital-massaging head;

a handle means, whereby said digital head is removably attached thereto, said handle being tubular and shaped in a substantially U-shaped configuration, wherein one end thereof is provided with a grip bar;

an insert-depth control means adjustably mounted to said handle adjacent said digital head to selectively control the depth of insertion into the rectum of an individual, whereby said digital head is positioned adjacent the prostate gland; and manipulating means included therein which is operably attached to said digital head, whereby said head is actuated in a massaging action with respect to said prostate gland, and wherein said digital head includes:

a base member molded to the base of said digital head, said digital head being formed from a soft, flexible material, and an elongated, flat spring member secured to said base member and disposed within said digital head, said spring having a free end attached to said manipulating means.

2. A prostate-massaging device as recited in claim 1, wherein said device includes:

an intermediate neck member, one end of which is removably connected to said handle, the opposite end thereof being arranged to removably receive said digital head, and a releasable coupling means positioned between said handle and said neck member, said depth-control means being adjustably mounted to said neck member adjacent the digital head.

3. A prostate-massaging device as recited in claim 2, wherein said manipulating means comprises:

a cord disposed within said tubular handle, said cord having one end thereof extending through said neck member;

a linkage member, wherein one end thereof is attached to said spring member; and a swivel connector connected between said cord and said linkage member.

4. A prostate-massaging device as recited in claim 3, wherein said insert-depth control comprises:

a pair of vertical slots having a plurality of lateral slots extending therefrom, said slots being formed in said neck member; and an annular plate having a central opening disposed therein;

a pair of tabs arranged to be slidably received within said slots to selectively adjust the depth by which said digital head will be positioned within the rectum.

5. A prostate-massaging device as recited in claim 4, wherein said soft, pliable material of said digital head comprises a surgical rubber.

* * * * *